US005367444A

United States Patent [19]

Bornhorst et al.

[11] Patent Number: 5,367,444

[45] Date of Patent: Nov. 22, 1994

[54] THERMAL MANAGEMENT TECHNIQUES FOR LIGHTING INSTRUMENTS

[75] Inventors: James M. Bornhorst, DeSoto; Richard W. Hutton, Irving; Timothy D. Stacy, Plano, all of Tex.

[73] Assignee: Vari-Lite Inc., Dallas, Tex.

[21] Appl. No.: 70,489

[22] Filed: Jun. 1, 1993

Related U.S. Application Data

[63] Continuation of Ser. No. 940,664, Sep. 4, 1992, abandoned, which is a continuation-in-part of Ser. No. 809,698, Dec. 16, 1991, Pat. No. 5,186,536, which is a continuation-in-part of Ser. No. 578,594, Sep. 6, 1990, Pat. No. 5,073,847.

[51] Int. Cl.[5] ..... F21V 21/00; F21V 9/02

[52] U.S. Cl. ..... 362/264; 362/283; 362/293; 362/345; 362/294; 362/2

[58] Field of Search ..... 362/264, 277, 281, 283, 362/293, 345, 2, 294

[56] References Cited

U.S. PATENT DOCUMENTS

| | | | |
|---|---|---|---|
| 1,619,198 | 3/1927 | Edison . | |
| 2,312,561 | 3/1943 | Leonard | 362/294 |
| 2,909,652 | 10/1959 | Pratt | 240/3 |
| 2,913,572 | 11/1959 | Fritzlen . | |
| 2,950,382 | 8/1960 | Hatch | 240/3.1 |
| 3,080,474 | 3/1963 | Allen . | |
| 3,174,067 | 3/1965 | Bahrs | 313/110 |
| 3,426,189 | 2/1969 | Deputy . | |
| 3,571,588 | 3/1971 | Hilzen | 240/47 |
| 3,604,922 | 9/1971 | Steel . | |
| 3,609,339 | 9/1971 | Smith . | |
| 3,626,176 | 12/1971 | Tsugami | 240/47 |
| 3,628,601 | 12/1971 | Snaper | 165/47 |
| 3,644,601 | 2/1972 | Miller et al. | 260/972 |
| 3,665,179 | 5/1972 | McLintic | 240/41.3 |
| 3,703,635 | 11/1972 | Burkarth | 362/264 |
| 3,766,377 | 10/1973 | Junginger | 240/41.15 |
| 3,864,547 | 2/1975 | Ray | 219/343 |
| 3,944,320 | 3/1976 | McLintic | 350/1 |
| 4,186,536 | 2/1993 | Bornhorst | 362/281 |
| 4,240,133 | 12/1980 | Haina et al. | 362/293 |
| 4,254,454 | 3/1981 | Hardin, Jr. | 362/282 |
| 4,315,186 | 2/1982 | Hirano et al. | 313/111 |
| 4,495,549 | 1/1985 | Carlson et al. | 362/62 |
| 4,546,420 | 10/1985 | Wheeler et al. | 362/264 |
| 4,602,321 | 7/1986 | Bornhorst | 362/268 |
| 4,701,833 | 10/1987 | Bornhorst | 362/294 |
| 4,890,208 | 12/1989 | Izenour | 362/294 |
| 4,974,136 | 11/1990 | Noori-Shad et al. | 362/293 |
| 4,980,806 | 12/1990 | Taylor et al. | 362/85 |
| 4,985,815 | 1/1991 | Endo | 362/345 |
| 5,073,847 | 12/1991 | Bornhorst | 362/293 |
| 5,083,252 | 1/1992 | McGuire | 362/2 |
| 5,091,835 | 2/1992 | Malek et al. | 362/345 |
| 5,169,228 | 12/1992 | Breitzler | 362/293 |
| 5,169,229 | 12/1992 | Hoppert et al. | 362/293 |
| 5,183,328 | 2/1993 | Osteen | 362/345 |
| 5,186,536 | 2/1993 | Bornhorst | 362/281 |

OTHER PUBLICATIONS

European patent application 0140994 May 1985 12 pgs. Spec., 2 pgs. Dwgs.

Wentz, "Design of a Microprocessor Controlled Theater Lighting Instrument" (Thesis, Lehigh University, 1985).

Drawing and Descriptive Sheet "Horizontal Beam Water Coolled Spotlight" by G. Z. Izenour, 58 pages.

*Primary Examiner*—Carroll B. Dority

*Attorney, Agent, or Firm*—Morgan & Finnegan

[57] ABSTRACT

An automated lighting instrument according to the present invention includes multiple motorized parameters and operates at a low noise level with improved thermal management devices such as a reflector coated with a cold mirror film, a metallic heat sink, a housing with ventilating holes, and thermally isolating motor mounts. The improved thermal management devices provide the basis for an improved method for managing the thermal characteristics of the automated lighting instrument of the present invention.

25 Claims, 18 Drawing Sheets

THERMAL MANAGEMENT TECHNIQUES FOR LIGHTING INSTRUMENTS

CONTINUATION DATA

This application is a continuation of application Ser. No. 940,664, filed Sep. 4, 1992, now abandoned which is a continuation-in-part of application Ser. No. 809,698, filed Dec. 16, 1991 and now U.S. Pat. No. 5,186,536, which is a continuation-in-part of application Ser. No. 578,594, filed Sep. 6, 1990, now U.S. Pat. No. 5,073,847.

TECHNICAL FIELD

The present invention relates to entertainment lighting equipment, particularly automated instruments having motorized mechanisms.

BACKGROUND OF THE INVENTION

Conventional fixed-focus lighting instruments typically include a 1000 watt incandescent lamp, such as a Par (Parabolic Aluminum Reflector) 64 lamp with integral reflector, mounted in a cylindrical metal housing suspended within a metal yoke. The lamp produces a high intensity beam which includes a visible portion and a potentially damaging infrared portion. The heat generated by the lamp is partly alleviated by free convection through ventilation holes at the lamp housing. Heat tolerant materials must be used within the housing to avoid damage from the heat or frequent replacement.

The instrument may be hung from pipes or trusses suspended over a stage and adjusted manually for azimuth and elevation (focus). Thereafter the focus of the instrument remains fixed throughout the ensuing performance. Typically, a frame mounted on one end of the lamp housing holds a sheet of colored plastic or "gel" which is used for imparting a particular color to the light beam. The gel is installed manually, and the color of the beam remains fixed throughout the performance. Burning of the sheet or gel due to the heat from the beam requires changing of the sheet or gel, which may not be an easy task when the instrument is hung, especially if changing is required during a performance.

More recently, motorized gel-changer mechanisms have been installed on conventional fixed-focus lighting instruments to vary the color of the light beam during a performance. These gel-changer mechanisms may include a motor to wind and unwind a scroll of gels which are taped together and may further include control electronics responsive to a control signal input to position a selected gel in front of the light beam. A fan is then necessary to provide forced air cooling for the gel scroll, the control electronics and the motor. Without the fan, the high temperature within the lamp housing may cause the gel to burn or cause the electronics to fail.

Automated luminaries include within their housings motorized mechanisms for varying multiple parameters. For example a motorized yoke assembly may be used for adjusting the azimuth and elevation of the lamp housing; motorized mechanisms for moving glass color filters for adjusting the color of the light beam; and lenses and other beam shaping devices coupled to motorized mechanisms for adjusting the size and shape of the light beam. Control electronics responsive to control signal inputs may also be included within the lamp housing and/or the motorized yoke assembly. One or more fans are usually required to cool the motors and electronics, as well as to cool various parts of the motorized mechanisms. Louvers and baffles are included in the luminaire to permit hot air to exit the lamp housing while preventing stray light rays from exiting the housing in random directions.

One disadvantage of forced air cooling in entertainment lighting instruments becomes evident in certain applications in which the sound produced by the entertainers is at relatively low levels, such as in a stage play or opera. The noise generated by the fans incorporated in the lighting instruments, while not noticeable during a high-volume rock concert or country music show, can become distracting during the relatively quiet moments of a stage play, classical music performance or opera. However, reliable operation of an automated luminaire without forced air ventilation from fans or other improved heat management designs may be impractical if not impossible.

Accordingly, it is an object of the present invention to provide an automated lighting instrument having multiple variable parameters which includes improved heat management designs so that the instrument operates quietly without a fan.

SUMMARY OF THE INVENTION

In accordance with the present invention, an automated luminaire having multiple adjustable parameters including position, color, and beam shaping mechanisms operated by control electronics responsive to a control signal input includes a high-powered light source mounted within a cold-mirror reflector which is coupled to a heat sink having external fins. Ventilation holes positioned substantially throughout the lamp housing permit free air flow through the housing. Electric motors mounted within the lamp housing are supported by thermally isolating motor mounts and are provided with finned heat sinks. Heat shields are placed between the bulkhead of a color filter mechanism and the actuators coupled thereto, and are also placed between the lamp housing and the motorized yoke assembly which contains control electronics and motorized mechanisms for remotely positioning the lamp housing.

BRIEF DESCRIPTION OF THE DRAWINGS

A more complete understanding of the present invention may be had by reference to the following Detailed Description read in conjunction with the accompanying drawings, wherein.

DETAILED DESCRIPTION

Figure 1:
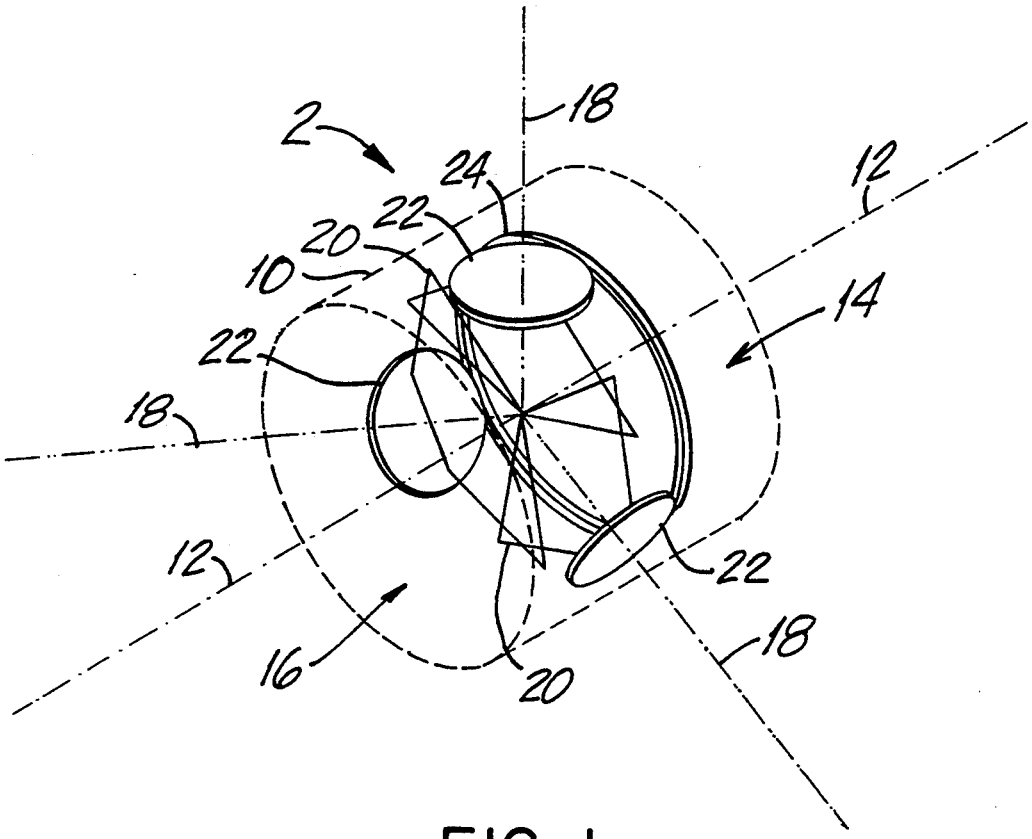
FIG. 1 is a schematic perspective view of a subassembly of pivotable filters in accordance with the present invention.

Referring now to FIG. 1, a pivoting-filter module or subassembly 2 which forms a part of the lighting instrument of the present invention will be described. The subassembly 2 is constructed within a tubular frame 10 (shown in phantom) having a longitudinal or primary axis 12 extending from an input aperture 14 to an output aperture 16. Three filters 20 are supported for rotation about respective axes 18 which preferably intersect the primary axis 12 to provide a radial arrangement when viewed from either end in the direction of the axis 12. The filters 20 comprise dichroic filters having identical optical characteristics and are pivotably supported near the axis 12 in a manner such as that described below with reference FIGS. 5B and 5C. The filters 20 are supported at their outer ends by gear wheels 22 which are interconnected by a suitable drive mechanism, such as ring gear 24, whereby all the wheels rotate simultaneously and at the same angular velocity.

The filters 20 can be pivoted about their axes 18 from a closed position as depicted in FIG. 1. to an open position in which they are substantially parallel to the primary axis 12. It will be appreciated that the filters 20 may be rotated to any intermediate position between the aforementioned positions. The subassembly 2 is further characterized in that all filters therein are presented at the same angle to a light beam which is parallel to the primary axis 12 and passes through the filters.

The subassembly 2 is adapted to receive a white light beam through the input aperture 14, selectively change the color of the light beam as the beam passes through the filters 20, and transmit the colored light beam through the output aperture 16. When the dichroic filters 20 are in the closed position, it will be appreciated that virtually all of the rays of the light beam are intercepted by the filters. When the dichroic filters 20 are rotated to the other extreme position in which they are parallel to the longitudinal axis 12, essentially none of the rays of the light beam are intercepted by the filters. By positioning the filters 20 at selected positions between such extreme positions, the hue and saturation of the resulting light beam can be varied in a controlled manner.

The dynamic color-changing effects achieved by the present invention are determined by the characteristics of dichroic filters. U.S. Pat No. 4,392,187 discloses changing the angle of incidence of a dichroic filter relative to a light beam to cause the color spectrum transmitted through the filter to be varied. Dichroic filters work on an interference principle, essentially separating two colors out of a white light source, one color being transmitted and the other color, the complement of that being transmitted, being reflected. The color transmitted through the dichroic filter depends upon the types of material used in the filter layer and their refractive indices, the thickness of each layer, the number of the layers, and the angle of incidence of the white light source striking the surface of the filter. By varying the angle of incidence of the filters, a preselected range of colors may be produced.

The dichroic filters for use with the present invention may comprise numerous commercially available filters made from dielectric film coating on glass or the like. The dichroic film is made of multiple layers in which alternate layers have low and high indexes of refraction, respectively.

Figure 2:
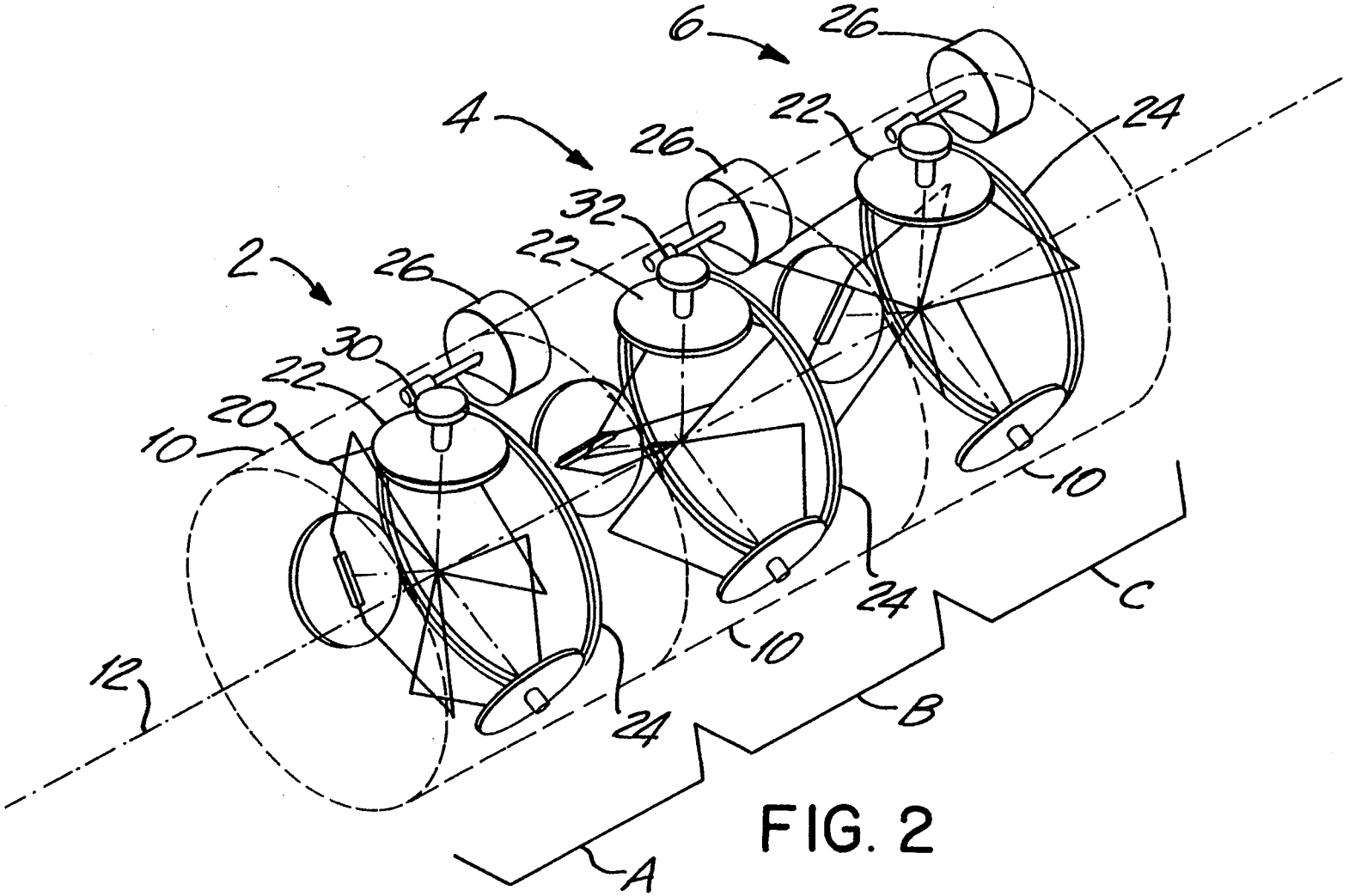
FIG. 2 is a schematic perspective view of three adjoining subassemblies or modules of pivotable filters showing different filter orientations.

Referring now to FIG. 2, three subassemblies or modules 2, 4 and 6 are connected in optical series relationship with their frames 10 (shown in phantom) abutting to form a single tubular arrangement. Each module has a set of three dichroic filters which are pivotable in the manner described above with reference to the filters 20 of FIG. 1.

The sets of filters of FIG. 2 are shown rotated to different positions. Module 2 shows filter set A with its filters in the closed position in which they intercept substantially all of the light rays passing through module 2.

Module 4 shows filter set B with its filters aligned substantially parallel to the longitudinal axis 12. This position will be referred to as the open position in which the filters intercept essentially none of the light rays passing through the module.

Module 6 shows filter set C with its filters disposed in an intermediate position between the open and closed positions. The actual intermediate position shown in FIG. 2 is such that the planes defined by the filters of set C are each disposed at 45-degree angles to the longitudinal axis 12.

In the embodiment shown in FIG. 2, all of the filters of each set have their axes of pivotable movement intersecting the primary axis 12 at a common point. In the preferred embodiment, the axes of pivotal movement of the filters of each set define a radial plane. The present invention contemplates various alternative configurations in which the filters of each set are staggered in position so that their axes do not intersect the primary axis 12 at a common point. In one such configuration, the axes of pivotal movement of the filters within each set are spaced apart slightly along the primary axis 12 so that the filters, when in the closed position, have the appearance of stairs in a spiral staircase.

In a preferred arrangement, the filters of set A consist of long-wave pass amber filters, the filters of set B consist of short-wave pass blue filters, and the filters of set C consists of complex-color magenta filters. In such an arrangement, the lighting instrument is capable of producing a large selection of beam colors due to the combined effect of the three sets of filters in series.

It will be appreciated that at least some degree of white light is passed through module 6 if the filters therein are positioned in intermediate positions other than a range of positions near the closed position. In like manner white and colored light leaving module 6 may pass partially around the filters of module 4 if they are not in the closed or near the closed position. The same is true of light passing through module 2.

Figure 3:
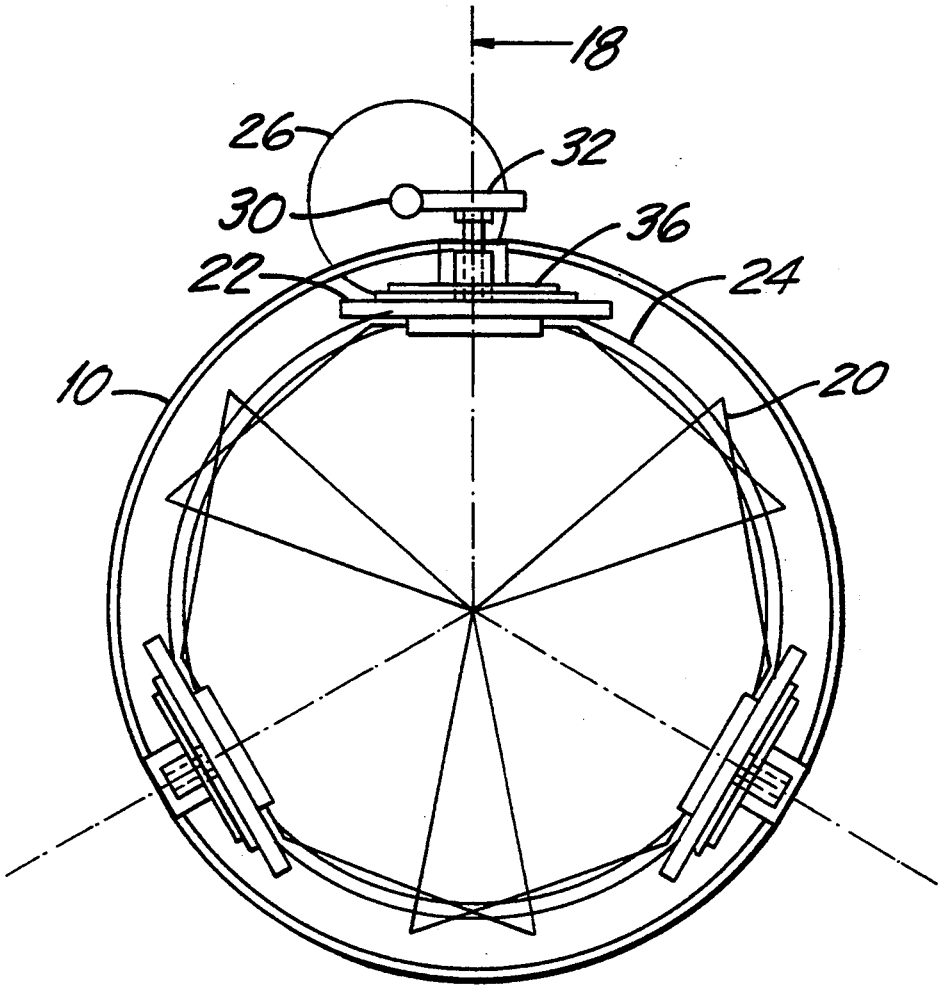
FIG. 3 is a schematic end view of the embodiment of FIG. 2.

Referring now to FIG. 3, a preferred drive mechanism for pivoting the filters 20 will be described. Each set of three filters is pivoted under the control of a bi-directional stepper motor 26 mounted to the frame 10 in a suitable manner (not shown). The shaft 28 (FIG. 2) of the motor 26 terminates in a worm gear 30. A worm wheel 32 is mounted on one of the filter supporting wheels 22 by means of a drive shaft 34. Each filter supporting wheel 22 has a geared periphery which engages complementary gear teeth on ring gear 24 as schematically depicted in FIGS. 2 and 3. Because the filter supporting wheels 22 are the same size and each is driven by a ring gear 24 common to each module, all three filters of each module are rotated in synchronization. The motor 26 may be energized by a conventional control system (not shown) comprising motor driver circuits, feedback sensors, and suitable electronic control circuits. Referring again to FIG. 2, it will be appreciated that each filter set A, B and C is independently pivotable under the control of a separate drive motor 26.

Figure 4:
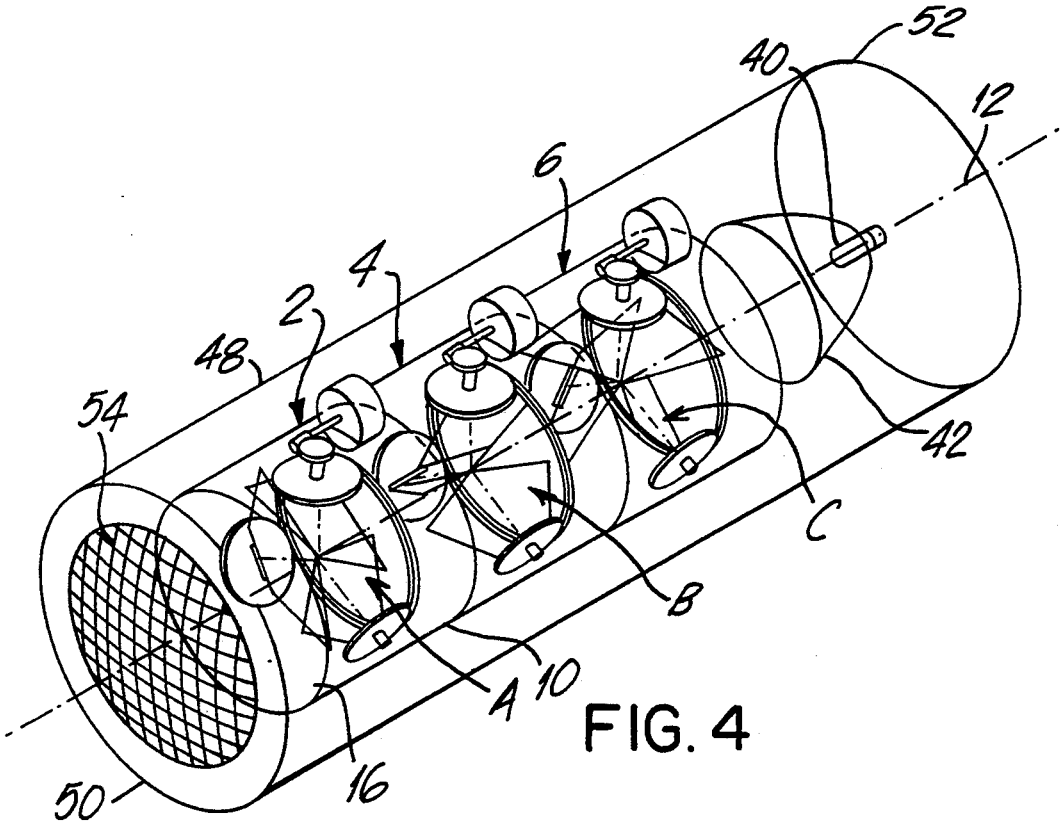
FIG. 4 is a schematic perspective view of a lighting assembly including the three modules of FIG. 2 enclosed within a cylindrical housing in accordance with one embodiment of the present invention.

Referring now to FIG. 4, a lighting instrument including the assembly of FIG. 2 is shown assembled in a cylindrical exterior housing 48. It will be appreciated that housing shapes other than cylindrical may also be employed. The housing 48 provides a means for mounting and protecting the filter modules and other components to be described. Conventional mounting hardware (not shown) is employed. The housing 48 is closed at the front end by bulkhead 50 and at the back end by bulkhead 52.

A lamp 40 and reflector 42 are mounted on the back bulkhead 52. The lamp 40 and reflector 42 serve as a light source to project a beam of light along the longitudinal axis 12. The beam first passes through pivoting filter set C, then passes through pivoting filter set B, and finally passes through pivoting filter set A.

A lenticular front glass 54 is also disposed transverse to axis 12, and intercepts the beam of light after the beam passes through pivoting filter set A. The glass directs the beam to provide a beam shape characteristic of wash luminaries. The glass is mounted in an aperture centered in front bulkhead 50.

The lighting instrument of FIG. 4 may be employed as one of many such instruments in an automated system such as described in the U.S. Pat. No. 4,392,187. In such a system, means are provided for suspending the lighting instrument, controlling its orientation and controlling such beam parameters as divergence and intensity. The lighting instrument of FIG. 4 depicts a unique arrangement of pivotal filters for controlling beam color and saturation.

To control beam intensity, lamp 40 may be a low-voltage incandescent type, such as a tungsten-halogen lamp, and may be coupled to an electronic dimmer (not shown). Alternatively, lamp 40 may be an arc lamp, such as a metal-halide discharge lamp and may be modulated in brightness or intensity by conventional mechanical dimming means (not shown) mounted within housing 48.

Figure 5A:
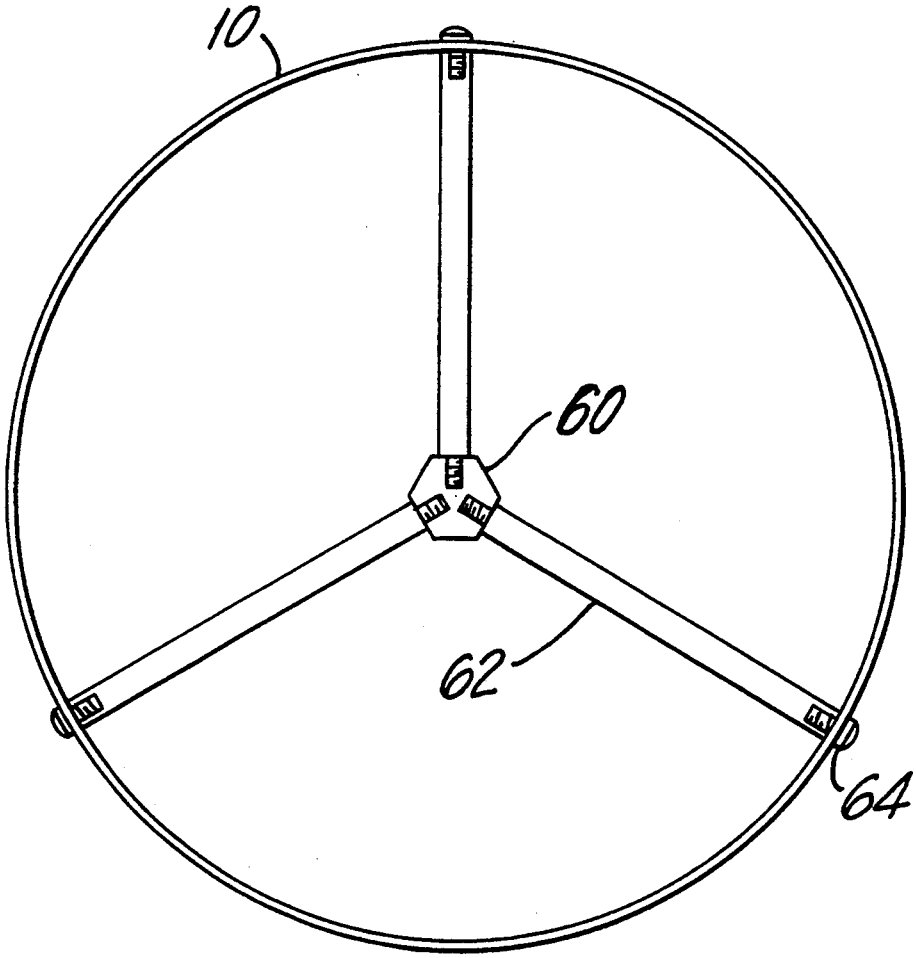
FIG. 5A is a cross-sectional view of a cylindrical frame showing a preferred center support according to the present invention.

A preferred technique for supporting the filters in tubular frame 10 is illustrated in FIG. 5A. A center support member 60, which preferably is a long aluminum bar of hexagonal cross-section, is supported within frame 10 by radial arms 62. The arms 62 have threaded ends secured in the member 60. Threaded fasteners 64 secure the arms 62 to the frame 10.

Figure 5B:
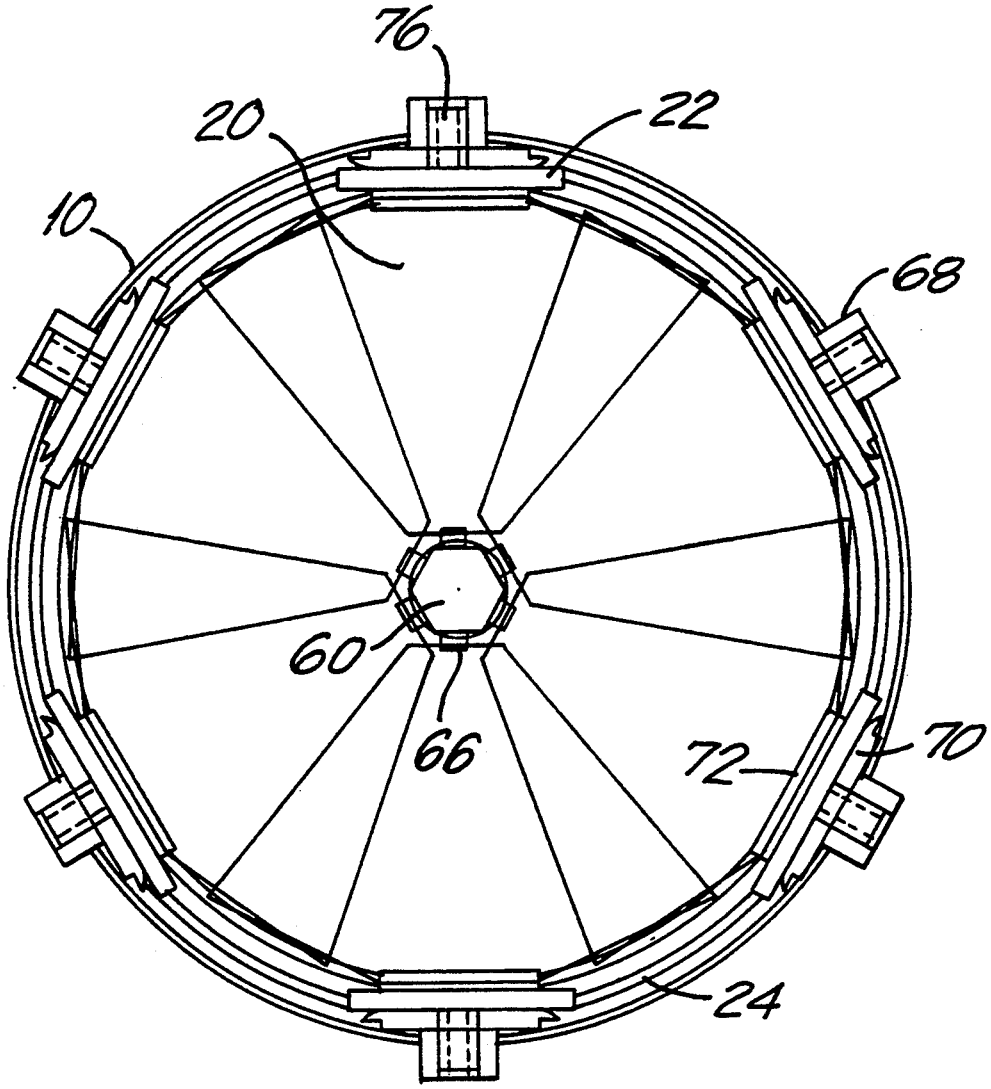
FIG. 5B is an axial cross-sectional view of a cylindrical frame showing one module of six pivotable filters used in a stage light according to another embodiment of the present invention.
Figure 5C:
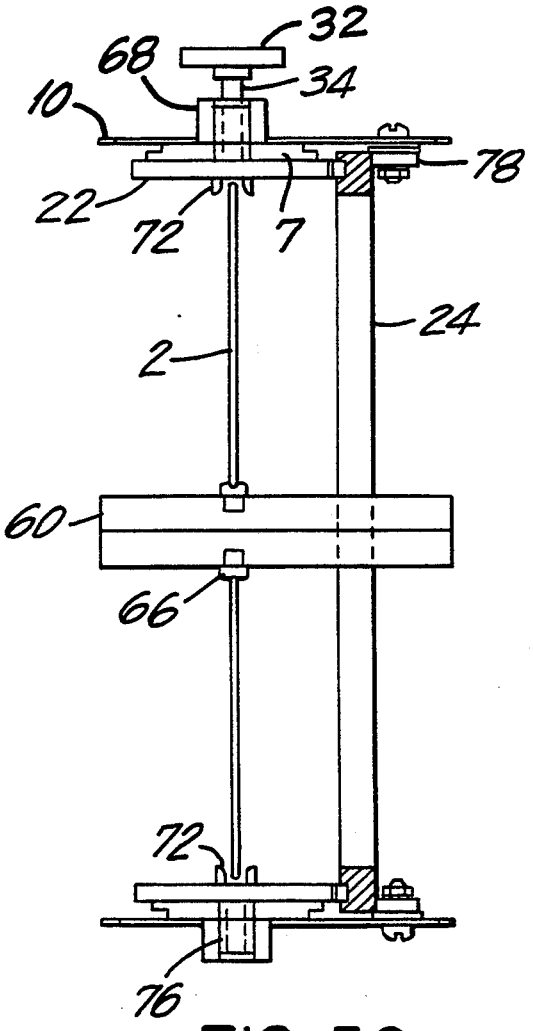
FIG. 5C is a radical cross-sectional view of the embodiment of FIG. 5B.

Referring now to FIGS. 5B and 5C, an alternatively arrangement of six dichroic filters is shown arranged radially about center support member 60. Each filter is fastened at its inner end to support member 60 by a U-shaped clip 66. Each clip 66 is rotatable with respect to the support member 60. Each filter 20 is supported at is outer end by a gear wheel 22 which has a U-shaped channel 72 on its inner fact for receiving the filter. Each gear wheel 22 is rotatably supported just inside the frame 10 by a bushing 68 secured in the frame wall. A low friction spacer or bearing 70 separates the gear wheel 22 from the bushing 68.

Each gear wheel has a hollow shaft 76 extending through the bearing 70 into the bushing 68. The material of the bushing 68 is chosen to present a minimum of friction between the bushing and the shaft 76 of the rotating gear wheel 22.

The gear wheels 22 are coupled for synchronous rotation by a ring gear 24, seen best in FIG. 5C. The ring gear 24 is maintained in engagement with the gear wheels by bearings 78 secured to the frame by suitable fastening means. To accomplish the rotation, one filter supporting wheel 22 is fitted with a drive shaft 34 which is inserted into the hollow shaft 76 of the selected wheel 22 and secured therein by a suitable adhesive. A worm wheel 32 is attached to drive shaft 34 to provide for motorized operation of the pivoting-filter assembly as described above with reference to FIG. 2.

Figure 5D:
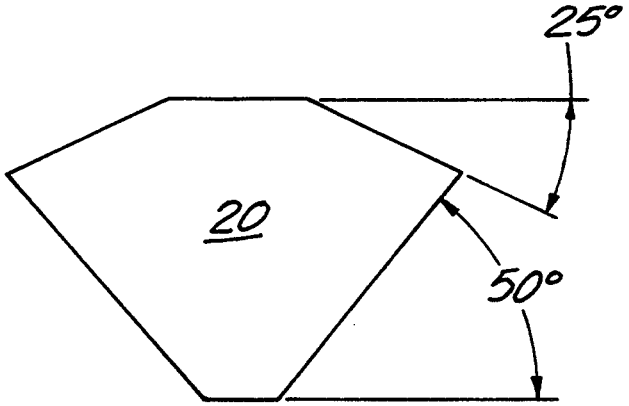
FIG. 5D is a plan view of one pivotable filter used in the embodiment of FIG. 5B.

The preferred shape of the filters employed in the embodiment of FIG. 5B is illustrated in FIG. 5D. The filter 20 is a six-sided irregular polygon having two parallel sides for mounting as described above. The shape of the filter is selected so that the arrangement of six such filters depicted in FIG. 5B will intercept substantially all of the light rays of the light beam in the intermediate positions between the fully closed position and the 45 degree position (i.e., half way between the fully closed and fully open positions).

It will be appreciated that embodiments of the invention can be constructed with any number of filters. The six-filter per set embodiment of FIG. 5B is believed to provide an optimum stage-lighting instrument. The three-filter per set embodiment of FIG. 4 is more suitable for smaller track lighting instruments for use in offices and is easier to illustrate in perspective view than the embodiment of FIG. 5B. One skilled in the art will readily appreciate the resulting structure achieved by substituting three modules of the six-filter embodiment of FIG. 5B for the modules 2, 4 and 6 of FIG. 4.

ASSOCIATED ACTUATION MECHANISMS

Figure 6:
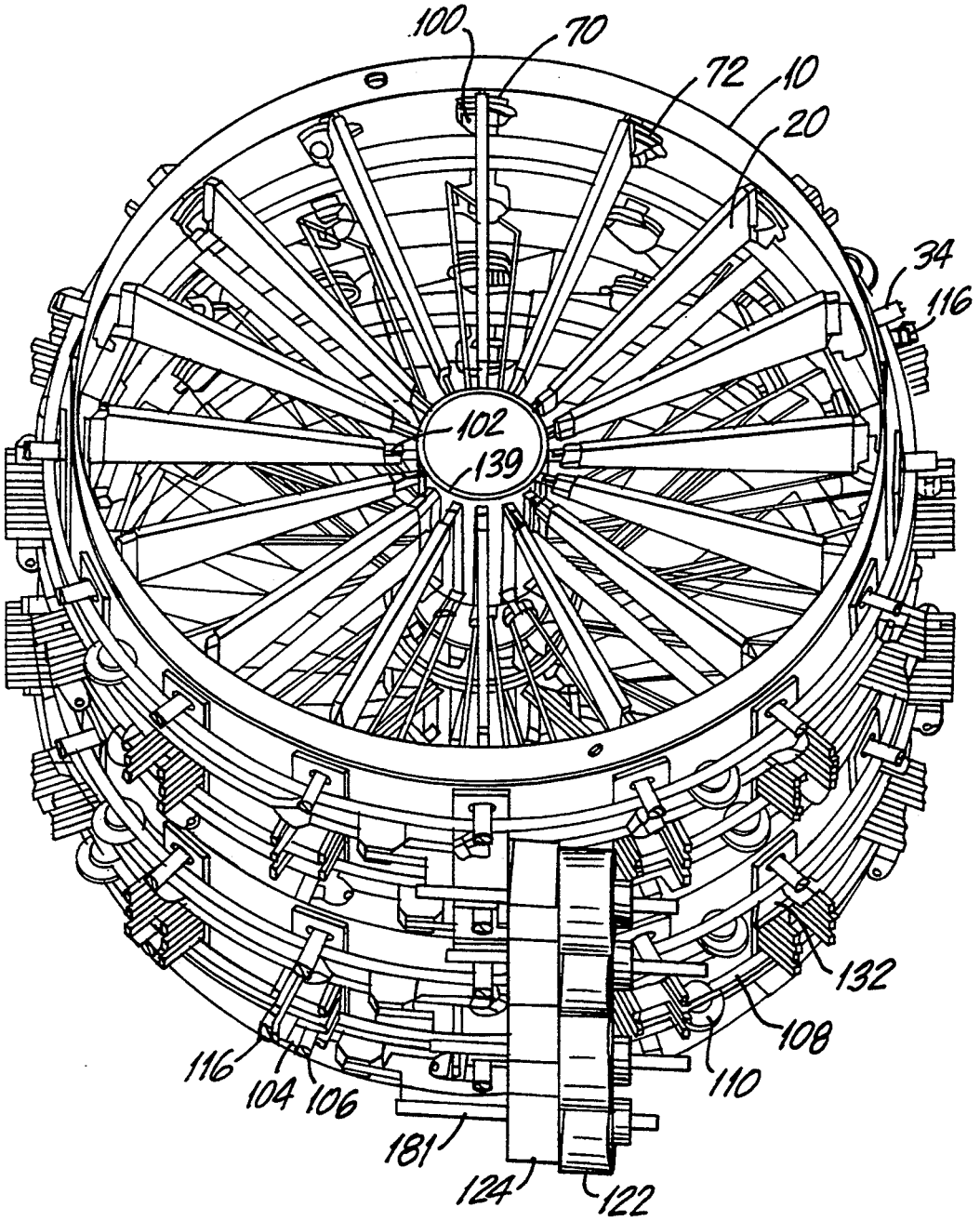
FIG. 6 is a perspective view of another embodiment of a lighting instrument illustrating multiple sets of filters mounted therein in accordance with the present invention.

FIG. 6 illustrates a lighting instrument according to another embodiment of the present invention. This embodiment features an alternative filter actuation mechanism for providing improved actuation control. As shown in FIG. 6, the lighting instrument includes a cylindrical frame 10 and multiple sets of color filters 20 mounted therein. Each set of filters 20 is disposed spaced apart along the longitudinal axis of said frame. The filters 20 are supported within the cylindrical frame 10 by large filter carriers 100 and small filter carriers 102. Each of the large filter carriers 100 rotates within a bushing 70. Each of the large filter carriers 100 includes a channel 72 for receiving one of the color filters 20 and a carrier shaft 34, which extends through bushing 70 and protrudes through one of a plurality of openings along frame 10.

Figure 7:
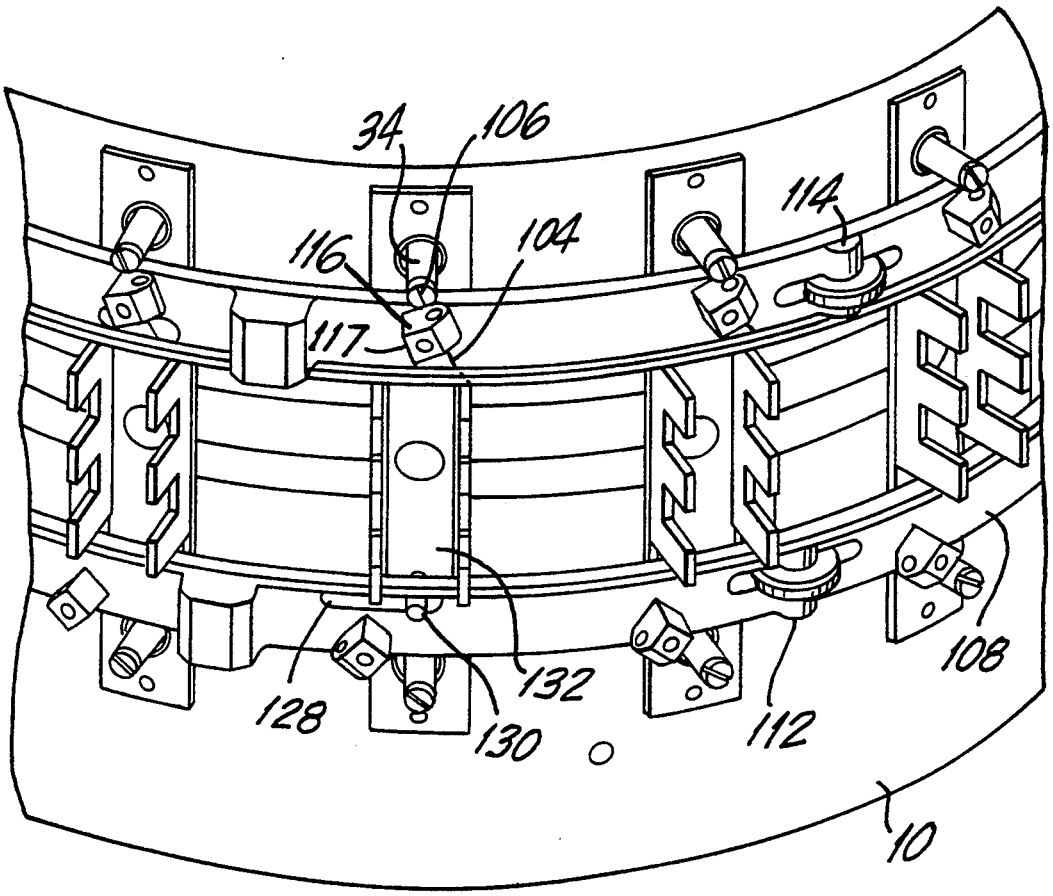
FIG. 7 is an expanded view illustrating coupling mechanisms for the color filters according to the present invention.

FIG. 7 is an expanded view of an outside portion of frame 10, showing mechanisms for coupling two sets of color filters 20 (FIG. 6). A length of spring wire 104 is secured to carrier shaft 34 and extends outwardly through and from slot 106 at the end of carrier shaft 34. The outward extension of spring wire 104 includes a straight portion for actuation linkage with coupling block 116. The spring wire 104 is preferably made with stainless steel.

Each of the coupling blocks 116 is pivotally mounted on ring 108 with a mounting post 117 and includes a hole through which the straight portion of spring wire 104 extends. The ring 108 encircles frame 10 and is rotatably supported on frame 10 by a plurality of rollers 110 attached to tabs 112 on ring 108. Rollers 110 are secured to tabs 112 by axle pins 114 driven through holes formed in the tabs. The ring 108 is preferably made from a semi-flexible, high-temperature thermoplastic such as polyphenylene sulfide with glass fiber reinforcement, which is similar to the Ryton material manufactured by the Phillips Petroleum Company.

With the above coupling mechanism, it can be seen that rotation of the ring 108 about the center of the cylindrical frame 10 will cause the color filters 20 (FIG. 6) to rotate about their respective axes, each of the respective axes being generally transverse to the longitudinal axis of the cylindrical frame 10.

Figure 8:
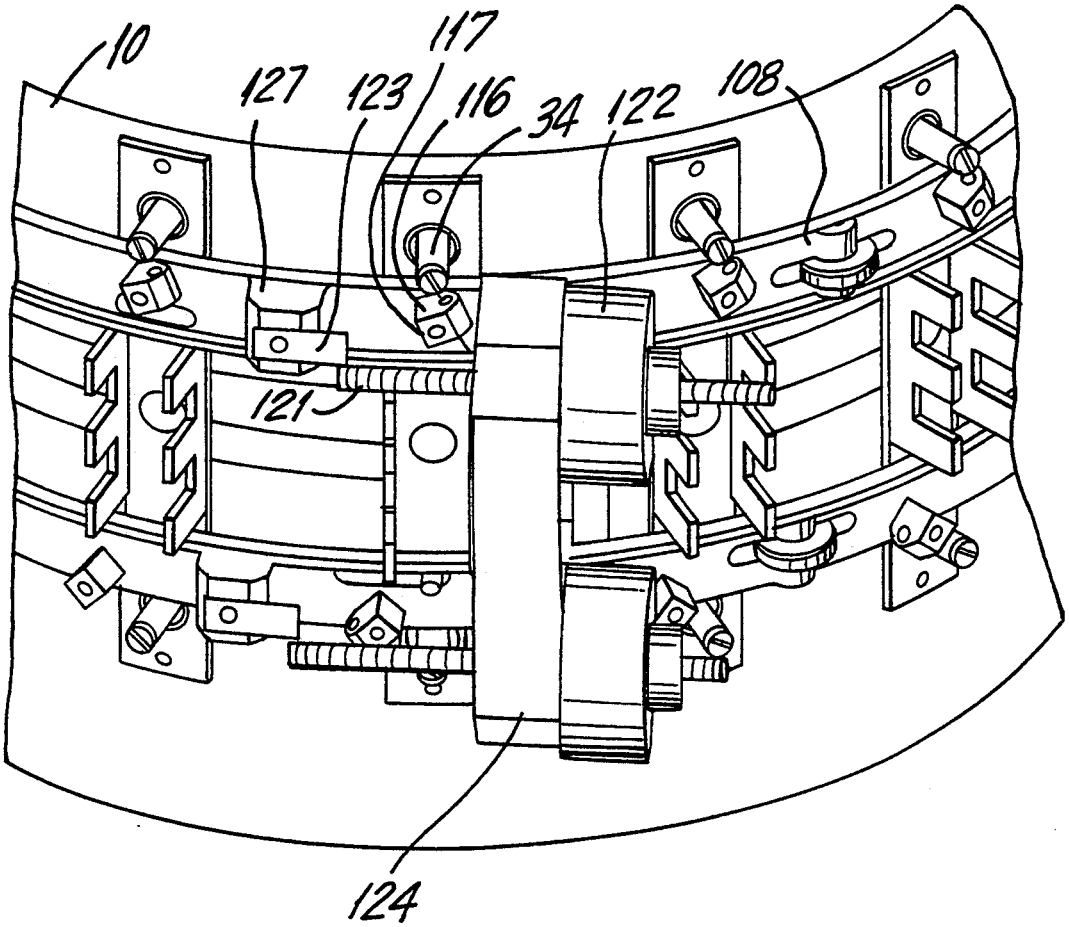
FIG. 8 is an expanded view of a drive mechanism according to the present invention.

FIG. 8 illustrates the driving mechanism according to the present invention. The driving mechanism may be a stepper motor 122 supported by a motor mount 124, which in turn is mounted on the frame 10. The stepper motor 122 includes a shaft 121 which is extended or withdrawn by the reversible action of the stepper motor 122. One end of the shaft 121 is engaged to a flexible bracket 123 which is preferably made from spring steel. This bracket 123 is secured to a tab 127. The tab 127 is part of the ring 108. Thus, when the motor 122 is driven in one direction, the shaft 121 extends, pushing on bracket 123 and tab 127 and thereby rotating the ring 108 about the central or main axis 12 of frame 10 and substantially concentrically with respect to frame 10. When the motor 122 is driven in the reverse direction, the ring 108 correspondingly rotates in the opposite direction.

The coupling mechanisms including the filter carrier shaft 34, spring wire 104 and the coupling blocks 116 allow for at least three degrees of freedom of movement. First, as the ring 108 rotates back and forth and the coupling blocks 116 travel past the shafts 34, the coupling blocks 116 pivot on their mounting posts 117 to accommodate the changing angle between the coupling blocks 116 and the filter carrier shafts 34.

Second, the distance between the coupling block 116 and the filter carrier shaft 34 varies as the ring 108 rotates. The spring wire 104 passes through a hole in the coupling block 116, but is otherwise not attached to the coupling block 116. The straight portion of the spring wire 104 is long enough to remain flexibly linked to the pivoting coupling block 116 at either extremes of travel, thereby accommodating the varying distance.

Third, the angle of elevation of the coupling block 116 with respect to the end of the filter carrier shaft 34, as viewed from the end of the cylindrical frame 10, varies as the ring 108 rotates, owing to the curvature of the frame 10. The straight portion of the spring wire 104 bends slightly to accommodate the varying angle.

With the drive and coupling mechanisms according to this embodiment of the invention, the filters 20 can be actuated through moving components having significantly reduced amounts of friction. Thus, the movement of the filters 20 and the filter carriers 100 (FIG. 6) has a very low backlash, especially when compared with a gear-driven arrangement. Therefore, a more energy efficient actuation mechanism with more precise actuation control is obtained.

Another improvement derivable from the present embodiment is attributed to the flexibility of the ring 108, which allows the cylindrical frame 10 to stray from being perfectly circular in cross section. The frame 10 may then be a relatively inexpensive sheet metal as opposed to a precision casting. If the frame 10 is slightly out-of-round, the semi-flexible ring 108 compensates for small distortions in the shape of the frame, riding over the slightly varying surface on the rollers 110.

Again, referring to FIG. 7, the semi-flexible ring 108 includes a plurality of slots 128 through which a guide post 130 can be inserted. The guide post 130 is attached to a carrier mounting bracket 132, which in turn is mounted on frame 10. As ring 108 rotates substantially concentrically with respect to the cylindrical frame 10, slots 128 and guide posts 130 maintain the longitudinal position of ring 108 and also limit the extent of travel of ring 108 around the frame 10.

Thus, the ring 108 is maintained in substantially the same longitudinal position so that spring wires 104 do not come out of the holes in pivoting coupling blocks 116. The extent of travel of ring 108 is physically limited by slots 128 and guide post 130 so that the ring 108 cannot be overdriven to the extent that the pivoting coupling arrangement is damaged.

The large color filter carriers 100 also incorporate travel-limiting features. As shown in FIG. 10, large filter carriers 100 include two end-of-travel stops 140 and 142 molded therein to limit the range of rotation of the filters 20. The angle between the two stops is carefully chosen so that the color filters 20 are parallel to the longitudinal axis 12 when fully open, and so that the color filters 20 do not touch each other when fully closed.

Again referring to FIG. 7, the length of slots 128 is carefully chosen so that ring 108 can be driven slightly farther in the open direction than filter carriers 100 will pivot. Spring wires 104 bend slightly in such a case so the flexible couplings are not damaged. Stepper motors 122 (FIG. 6) can be controlled by a microprocessor and memory based control system such as the system described in U.S. Pat. No. 4,980,806 to Taylor et al., the disclosure of which is incorporated herein by reference. When the control system is initialized, the motor control subsystem calibrates the mechanism by driving the stepper motors 122 in the direction which opens the color filters 20 (FIG.6). The motors are driven to the physical end-of-travel stops to ensure that all color filters 20 are set to a known position parallel to the main longitudinal axis 12 of the lighting instrument. No end-of-travel sensors are required, as the motor control subsystem can simply drive the stepper motor a few steps more than the number of steps required for the full range of travel, and thereafter begin counting and recording the number of steps moved. The control system maintains in memory a record of the current position of the corresponding filter set. The filters may then be driven open-loop, eliminating any requirements for end-of-travel sensors and control circuitry interface with such sensors.

Figure 9:
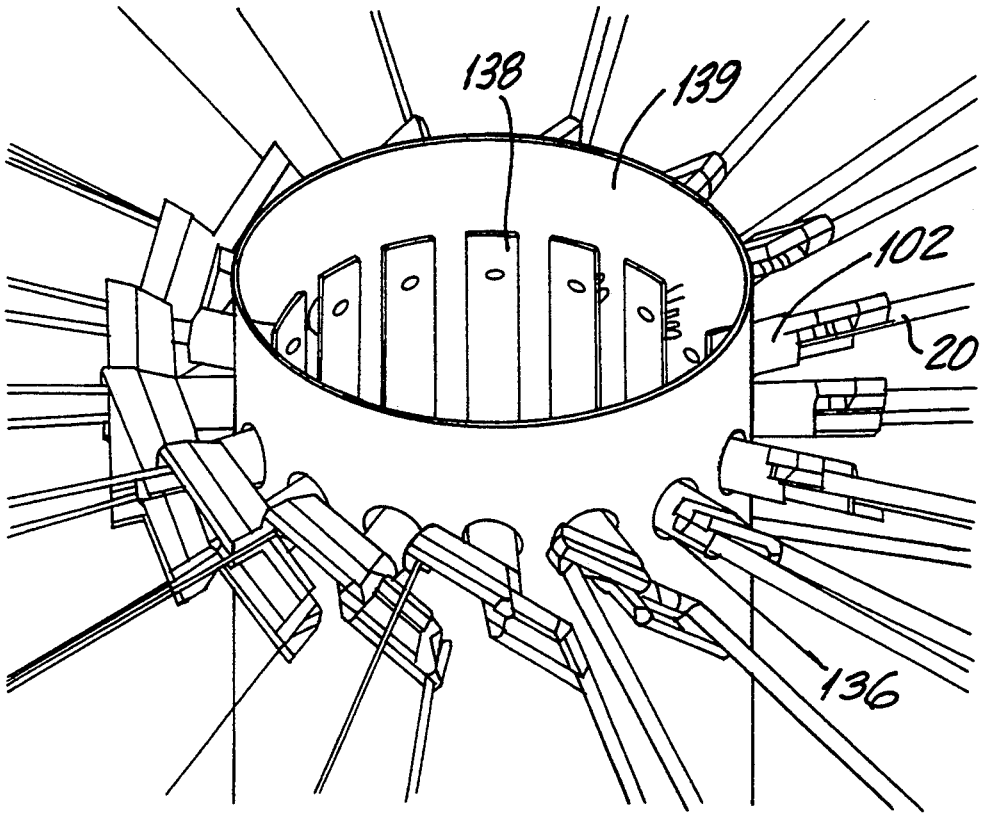
FIG. 9 is an expanded view illustrating the mounting of pivoting filter carriers to an axial hub.
Figure 10A:
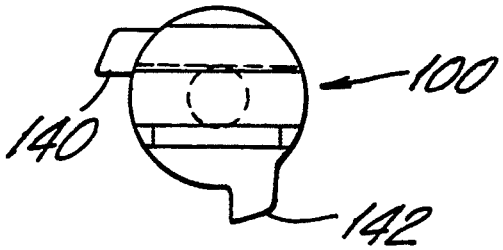
FIGS. 10A–10D illustrate the top, front, bottom and side views of a filter carrier, respectively.
Figure 10B:
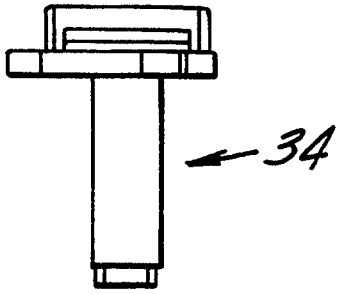
Figure 10D:
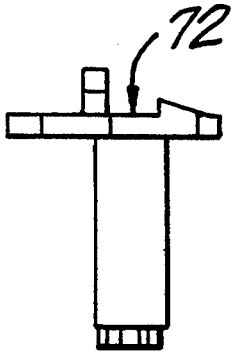
Figure 10C:
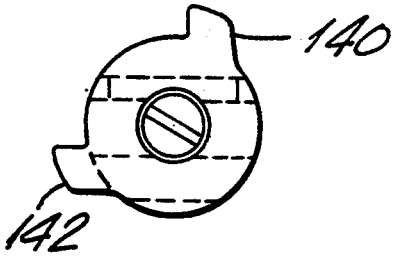

Another feature of the present invention relates to the mounting arrangement of the filters 20 and small filter carriers 102. FIG. 9 is an expanded view of a portion of the light instrument at or near the hub 139. As shown in FIG. 6 and 9, the hub 139 is suspended within frame 10 by support rods 134. The hub 139 includes a plurality of holes 136 into which are inserted small filter carriers 102. A compression apparatus, such as finger springs 138, mounted within hub 139 exerts pressure on the ends of small filter carriers 102 to press the combination of small filter carriers 102, filters 20, and large filter carriers 100 against bushing 70 mounted on the inner surface of frame 10. The finger springs 138 maintain the radial alignment of the coupling mechanisms including coupling blocks 116 and spring wires 104.

The present invention also contemplates applications other than for stage lighting. For example, a large lighting apparatus such as a search light for illuminating the night sky with different colored beams can be constructed using the foregoing techniques. In such an embodiment of the invention, a much larger number of pivoting filters is contemplated so as to minimize the axial dimension of the filter assembly. It will be appreciated that the disclosed radial arrangement of filters is ideally suited to the projection of a circular light beam and provides economic and performance advantages over square or rectangular filter arrangements.

THERMAL MANAGEMENT TECHNIQUES

Figure 11:
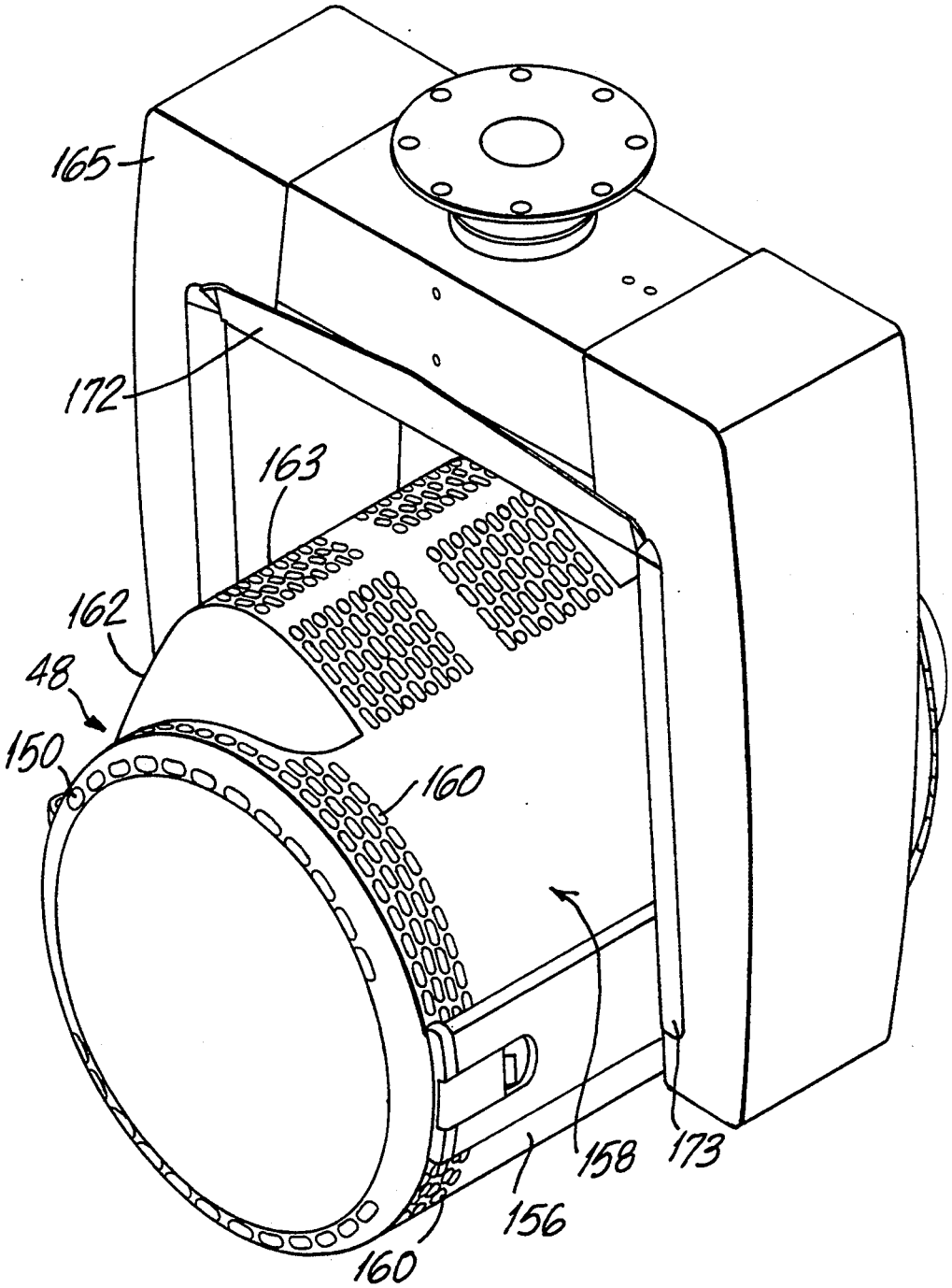
FIG. 11 is a perspective view of a lighting instrument according to an embodiment of the present invention.
Figure 12:
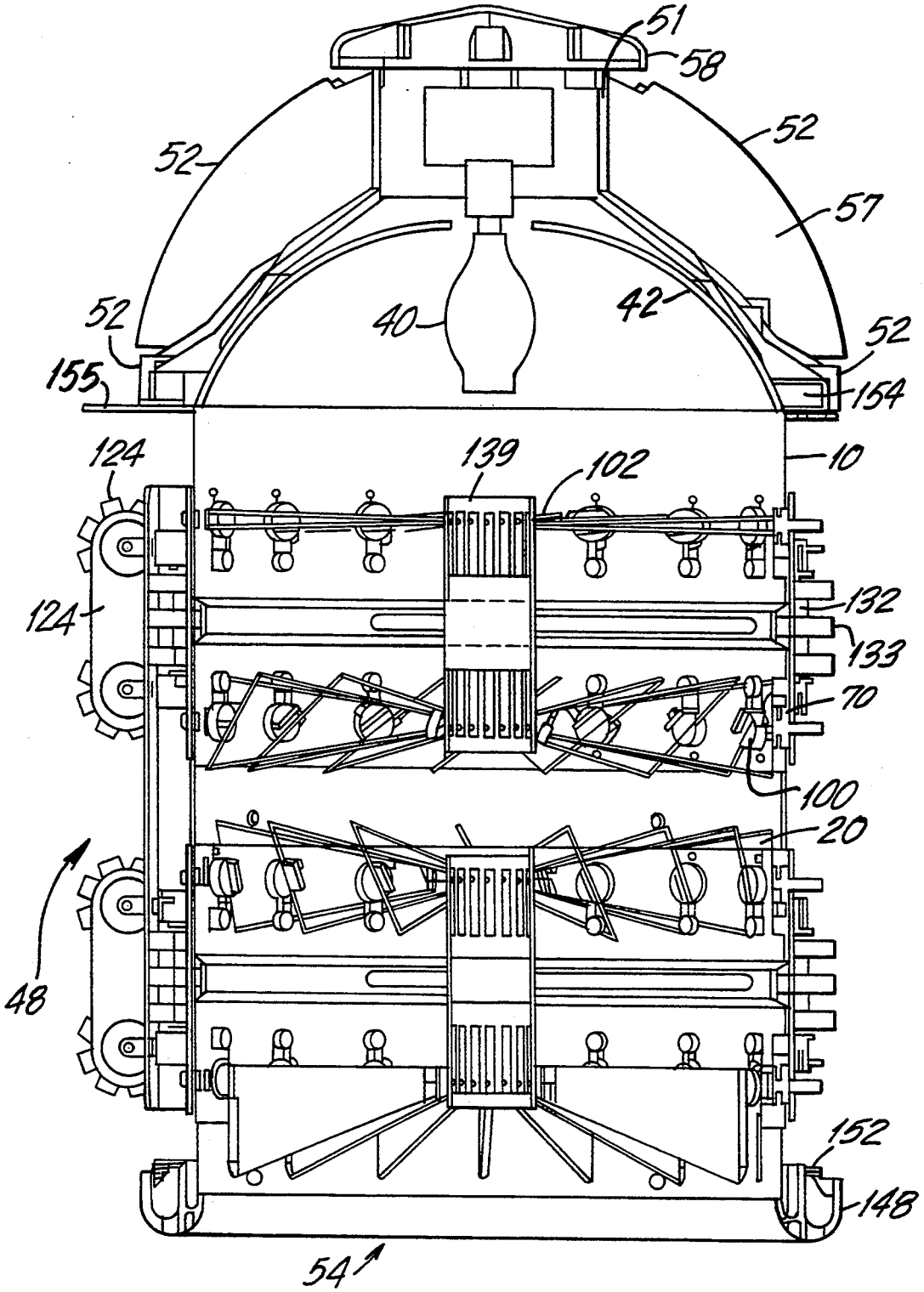
FIG. 12 is a cross-sectional view of the interior of a lighting instrument according to an embodiment of the present invention.

FIG. 11 illustrates the thermal management features of the present invention. The instrument includes a lamp housing 48 suspended within a motorized yoke assembly 165. The lamp housing of the present invention is preferably of the size of approximately 10 inches in diameter and 16 inches in length. FIG. 12 illustrates a cross-sectional view of the interior of the instrument according to the present invention. A light source 40, for example a 1000 watt incandescent lamp, is mounted within a reflector 42 for producing a light beam, which includes a visible portion and an infrared portion. Most of the heat generated by the beam is from the infrared portion. The reflector 42 is preferably made of heat resistant glass and is preferably coated on the side facing the lamp 40 with a multiple-layer dielectric film forming a "cold mirror", which is capable of reflecting visible light while allowing heat rays to pass through the film. A cold mirror coated reflector, along with other beam adjusting devices, are also described in our U.S. patent application Ser. No. 693,366, now U.S. Pat. No. 5,282,121, entitled "Improvements In High Intensity Lighting Projectors", the disclosure of which is incorporated by reference herein.

The reflector 42 is thermally connected to a heat sink 52, which is preferably made of cast aluminum. Preferably, the areas of contact of the heat sink 52 and reflector 42 may be furnished with a slightly flat region for providing better thermal contact.

The rear surface of the glass reflector is disposed proximally to the body of the heat sink. Most of the heat rays directed at the reflector pass through the film and glass substrate of the reflector 42 and strike the heat sink 52 which absorbs the rays as heat. A lesser amount of the heat rays are absorbed by the glass substrate of reflector 42 and are dissipated by convection through the vent holes (not shown) and by radiation to the heat sink 52.

The heat sink 52 includes a plurality of fins 57 formed in its rear portion, thereby providing increased surface area from which to radiate heat and provide increased free convection. The protruding fins 57 are oriented vertically so that hot air can flow freely upward between the fins, resulting in free convection unobstructed by the fins themselves. The base of the lamp 40 is coupled to a socket mounted within a cavity formed in the heat sink 52. An end cap 58 is installed over the end of the heat sink 52 to serve as a light baffle. A cavity 51 between the heat sink 52 and the end cap 58 provides space through which hot air can escape from around the lamp 40. The cavity functions as a chimney to cool the lamp socket when the lamp housing points straight down. The heat sink 52, lamp 40, and reflector 42 may be disposed at one end of the lamp housing 48. The light beam is directed through an exit aperture at the other end of the lamp housing 48.

Most of the heat produced by the lamp 40 passes through the cold-mirror coating of reflector 42 and is dissipated by radiation and convection via the glass substrate of the reflector and heat sink 52. The visible and cooler portion of the beam is projected out of the housing 48 for illuminating entertainers or the stage. Since the reflector 42 and heat sink 52 remove most of the heat, the optical elements and other system components disposed in the path of the beam are protected from excessive thermal stress.

Figure 13:
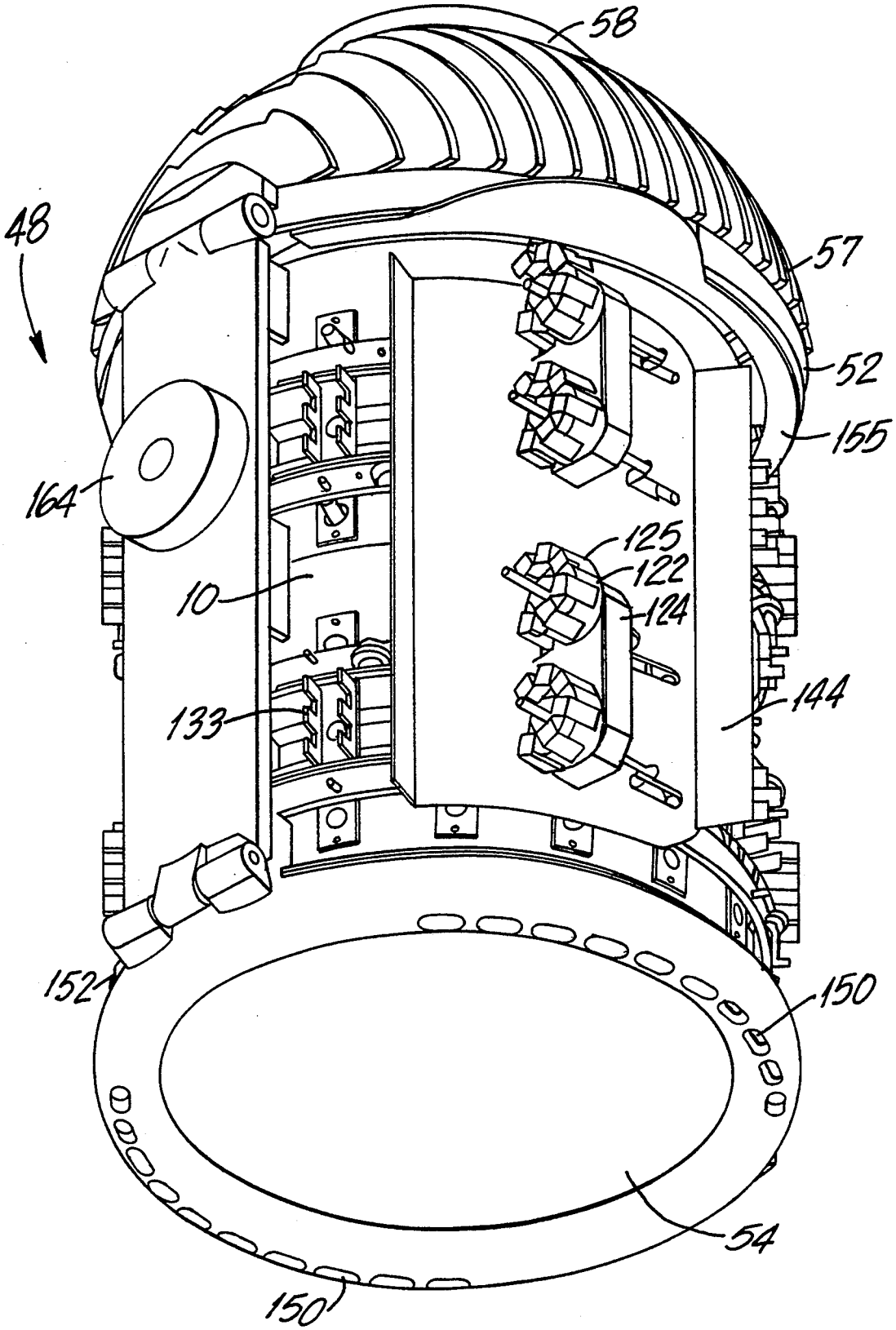
FIG. 13 is a perspective view of a lamp housing with covers removed.

FIG. 13 illustrates the lamp housing 48 with the covers 156, 158 (FIG. 11) removed to expose the filter actuating mechanisms. These are driven by motors 122, which are fitted with finned heat sinks 125 and are installed in a non-metallic molded motor mount 124, which is preferably made of composite material with low thermal conductivity. Ryton is used in the preferred embodiment. The motor mount 124 is in turn installed upon a metal plate 144 suspended a short distance away from the cylindrical bulkhead 10. The metal plate 144 acts as a shield against heat radiation emanating from the bulkhead 10. Thus, the motor is protected against failure due to excessive heat build-up within the housing of the motor by (1) the metal plate heat shield 144 which blocks heat radiation and convection from the bulkhead 10, (2) by the thermally-isolating motor mount 124 which resists heat conduction, and (3) by the finned heat sink 125 which tends to dissipate heat produced by electric current passing through the windings of the motor.

Again referring to FIG. 12, it may be recalled that the glass color filters 20 are supported within the bulkhead 10 by metal center filter carriers 102, metal outer filter carriers 100 and plastic bushings 70. The metal center filter carriers 102 are supported by a hub assembly 139 disposed generally along a longitudinal axis of the lamp housing and in the direct path of the light beam. The metal center filter carriers 102 are made of a material which is resistant to deformation due to heat. The metal outer filter carriers 100 are supported by carrier holders 132 fastened to the outer surface of the bulkhead 10.

The carrier holders include fins 133 which radiate heat absorbed from the bulkhead 10.

Referring to FIG. 13, a heat resistant glass lens 54 is disposed across the exit aperture of the lamp housing 48 and is supported by a front ring 148. A plurality of ventilation holes 150 formed in the front ring permit air to pass through the ring. Ventilation holes formed in the front portion of the bulkhead 10 permit air to pass through the bulkhead 10. Light baffles 156, 158 mounted to the cylindrical bulkhead block stray light rays from the beam. Heat deflector 155 blocks heat radiation and convection from the heat sink 52 to the motors. Metal covers 156, 158 fit around the bulkhead 10 enclosing the motors and filter actuation mechanisms and form an air chamber surrounding the cylindrical bulkhead. Referring to FIG. 11, holes 160 formed in the covers permit air to pass through the covers. A hump 162 is formed in cover 158 to accommodate the motors 122 installed in the thermally isolating motor mounts 124 as shown in FIG. 13. Ventilation holes 163 formed in the hump permit air to pass through the hump. The metal plates 144 upon which the motor mounts are supported form an air chamber under the hump which is separate from the air chamber surrounding the cylindrical bulkhead 10. Hot air surrounding the bulkhead is prevented from mixing with air surrounding the filter actuating motors 122. The lamp housing 48 is cooled by convection as hot air escapes through some of the ventilation holes while relatively cooler air is drawn in through other ventilation holes.

Figure 14:
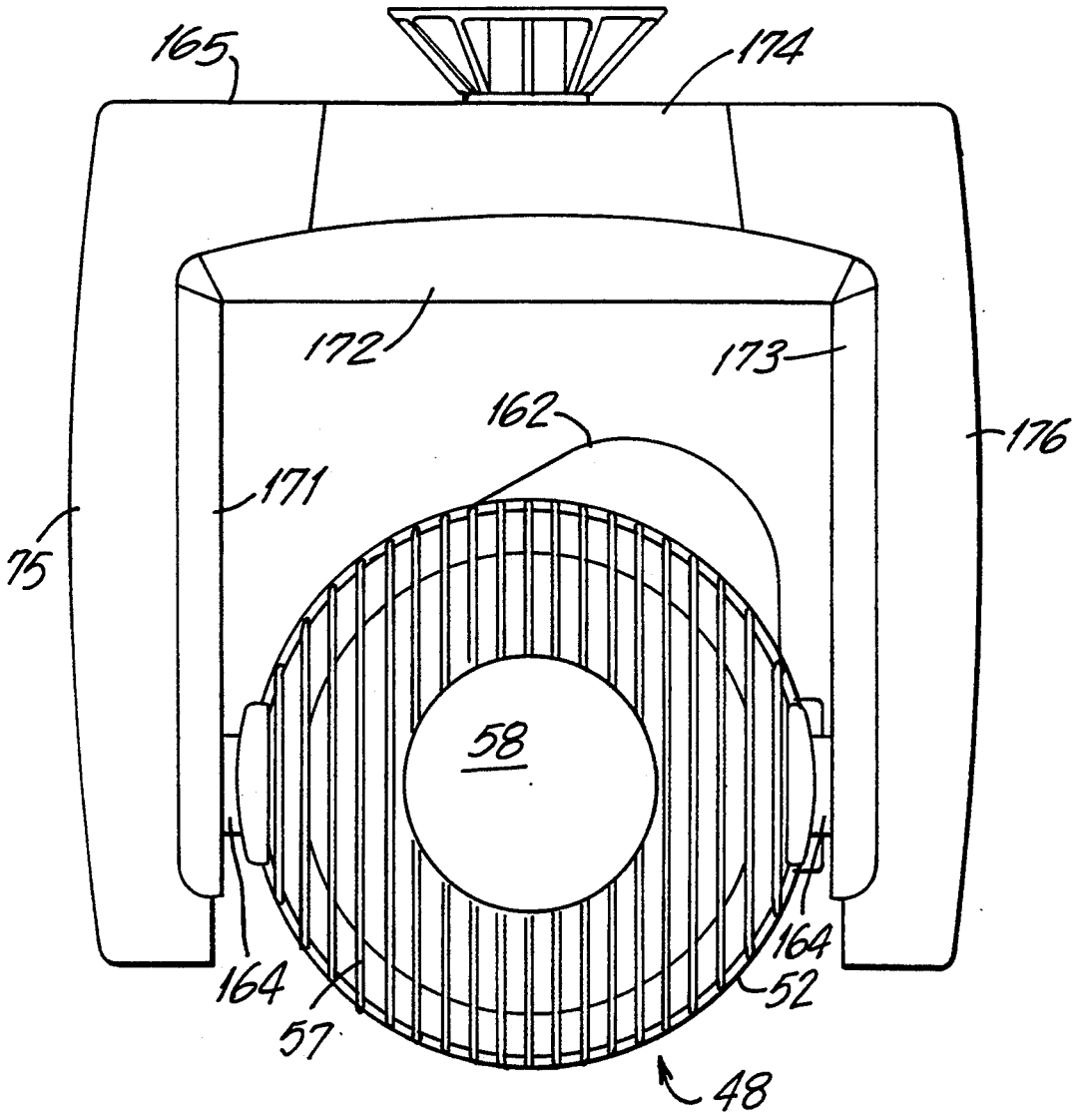
FIG. 14 illustrates the lighting instrument of FIG. 11 viewed from the rear of the lamp housing.
Figure 15:
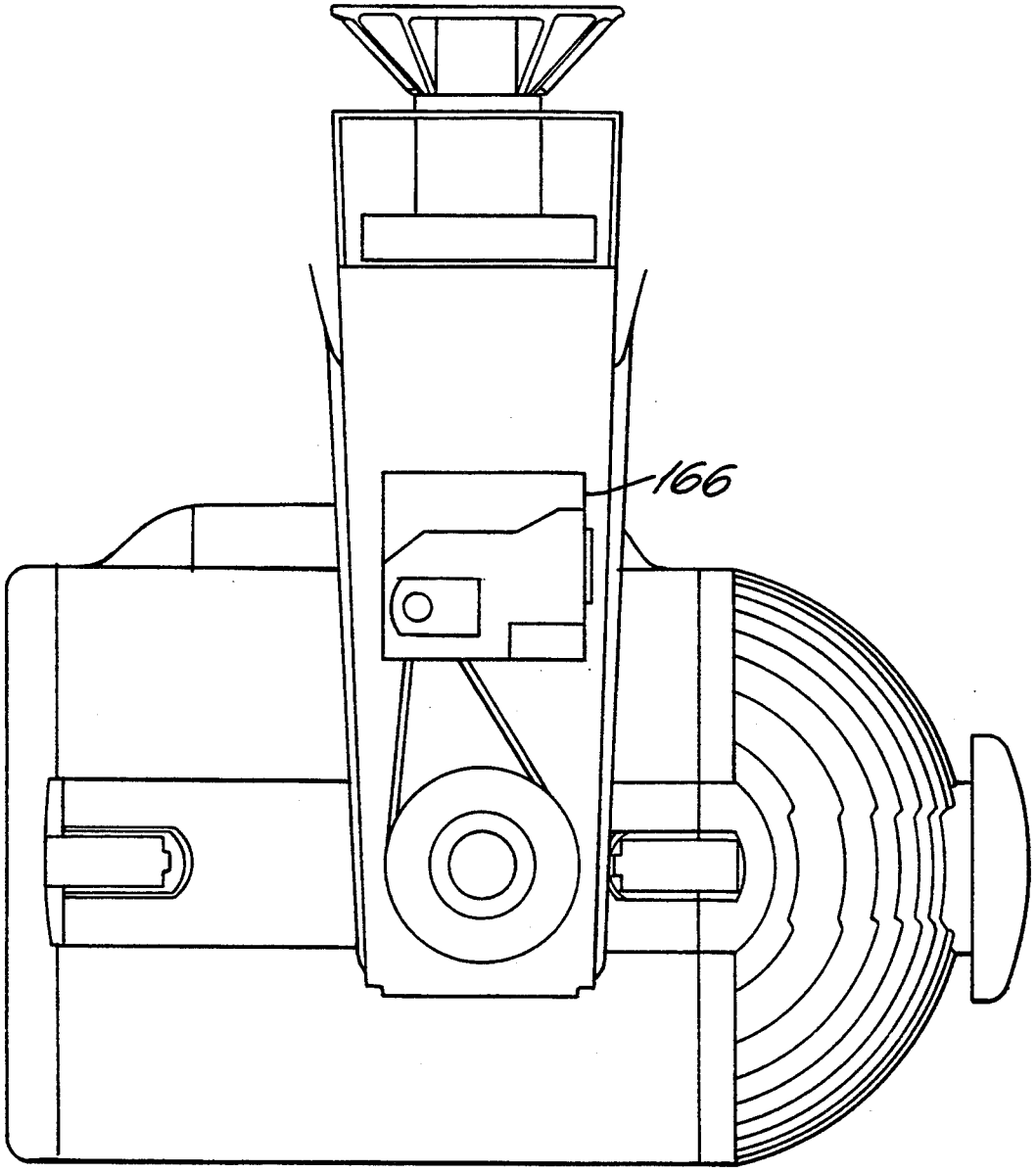
FIG. 15 is a right side view of the lighting instrument of FIG. 11 with a cut away view of a yoke assembly.
Figure 16:
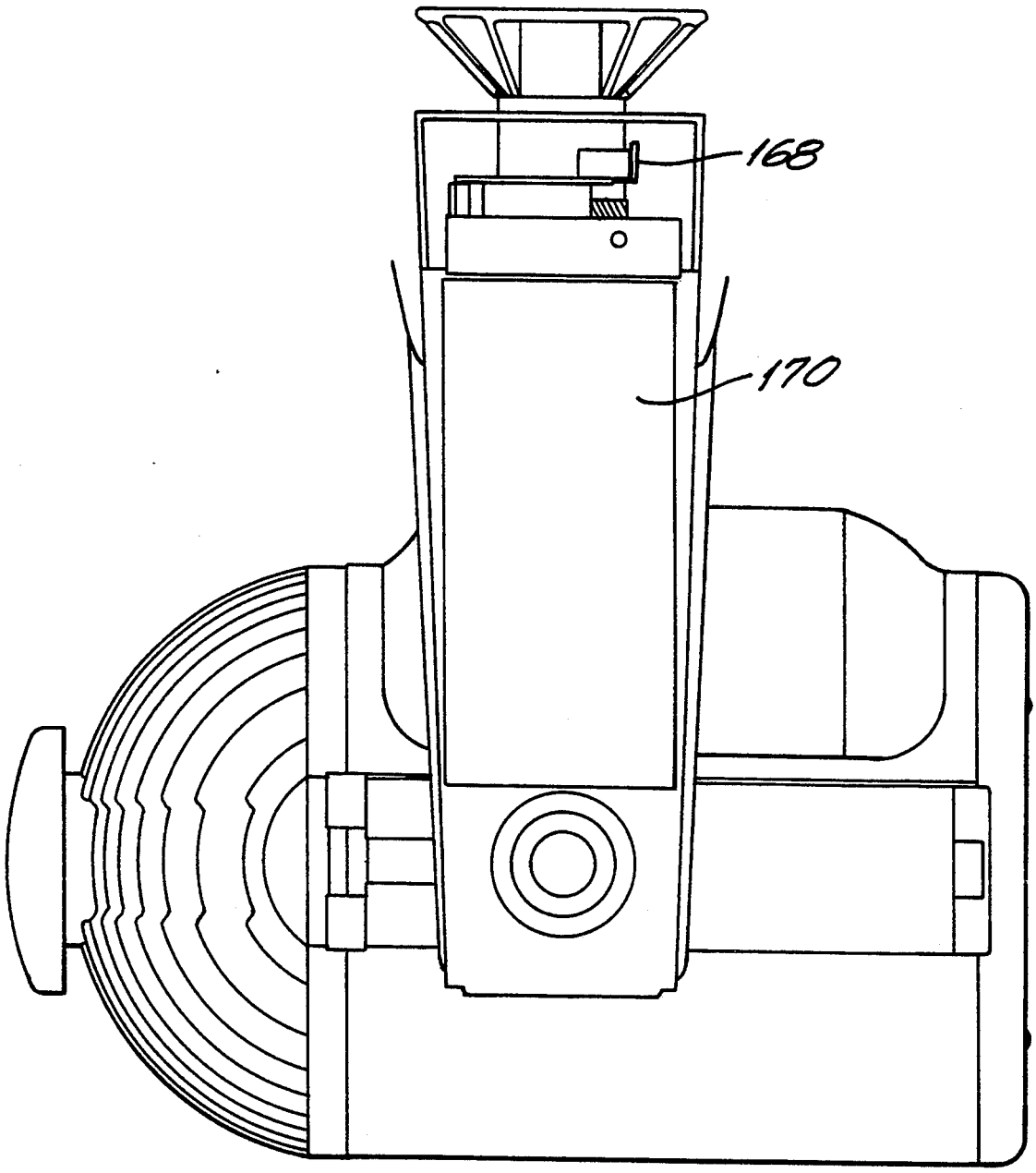
FIG. 16 is a left side view of the lighting instrument of FIG. 11 with a cut away view of the yoke assembly.

The lamp housing 48 is suspended within the motorized yoke assembly 165 supported by thermally insulating plastic tilt axles 164. The yoke assembly 165 encloses motorized mechanisms 166, 168 (See FIGS. 15 and 16) for remotely adjusting the position of the lamp housing with respect to azimuth and elevation. As shown in FIG. 16, control electronics 170 responsive to a control signal input may also be enclosed within the yoke assembly. The electronics include motor drive circuits for actuating the motors of the position adjusting mechanism and the filter actuation mechanism. As best seen in FIG. 14, metal plates 171, 172 and 173 interposed between the lamp housing and the yoke assembly are attached to a yoke cross member 174 and to each of two yoke legs 175, 176 and serve as heat shields protecting the yoke assembly from hot air and heat radiation emanating from the lamp housing 48. The position adjusting motors and electronic control circuits are protected from failure due to excessive heat build-up within the yoke assembly 165 by the effect of metal plates 171, 172 and 173.

The various thermal management features herein disclosed are designed to work in any orientation of the lamp housing since a principal feature of the lighting instrument is its ability to pan and tilt the lamp housing to a variety of orientations.

Although several embodiments of the invention have been illustrated in the accompanying Drawings and described in the foregoing Detailed Description, it will be understood that the invention is not limited to the embodiments discloses but is capable of numerous rearrangements, modifications, substitution of parts and elements without departing from the spirit of the invention.

We claim:

1. A lighting instrument having variable parameters, comprising:

a light source for producing radiant energy having a visible portion and an infrared portion;

a housing having a frame and first and second ends for enclosing said light source near said first end, said housing and said frame having ventilation holes for enhancing air flow through said frame and said housing;

a reflector disposed proximally to said light source for reflecting a portion of said energy and forming a light beam projected toward said second end, said reflector including a cold mirror film capable of reflecting said visible portion and transmitting said infrared portion of said energy;

a heat sink disposed proximally to said reflector for dissipating heat from said infrared portion which is transmitted to said reflector, said heat sink having heat conductive fins disposed externally to said frame;

a moveable color filter mechanism mounted to said frame in the path of said beam for varying the color of said beam;

at least one motor for driving said color filter mechanism; and a thermally isolating motor mount for mounting said motor to said frame.

2. A lighting instrument according to claim 1, wherein said heat conductive fins are disposed parallel to said beam.

3. A lighting instrument according to claim 1, further including a heat shield plate supporting said motor mount and a finned heat sink coupled to said motor.

4. A lighting instrument according to claim 1, further including a yoke attached to said housing, said yoke having motors for panning and tilting said housing, and means for thermally shielding said yoke from said housing.

5. A lighting instrument according to claim 1, further including a plurality of light baffles mounted to said frame and corresponding to said ventilation holes for blocking stray light rays from said beam.

6. A motorized lighting instrument comprising:

a housing for enclosing a light source in a free air-flow environment;

said housing including ventilation passages means for enhancing free air-flow through said housing;

reflector means for reflecting light from said light source for forming a light beam, said reflector means including means for transmitting heat rays from said light source;

means for dissipating heat from said reflector and said light source;

means for selectively modifying said beam including moveable color filter means disposed in the path of said beam for varying the color of said beam;

motor means disposed within said housing for driving said color filter means;

means for dissipating heat generated by said motor means; and heat shield means for isolating an air-flow environment surrounding said motor means from an air-flow environment surrounding said light beam.

7. A motorized lighting instrument according to claim 6, further including:

yoke means for suspending said housing, said yoke means further including means for pivoting said housing in pan and tilt directions; and heat shield means for isolating an air-flow environment surrounding said housing from an air-flow environment surrounding said yoke means.

8. A method for managing thermal characteristics in a lighting instrument having variable parameters, said lighting instrument including, a light source for producing radiant energy having a visible portion and an infrared portion;

a housing having a frame and first and second ends for enclosing said light source near said first end, said housing and said frame having ventilation holes for enhancing air flow through said frame and said housing;

a reflector disposed proximally to said light source for reflecting a portion of said energy and forming a light beam projected toward said second end, said reflector including a cold mirror film capable of reflecting said visible portion and transmitting said infrared portion of said energy;

a heat sink disposed proximally to said reflector for dissipating heat from said infrared portion which is transmitted to said reflector, said heat sink having heat conductive fins disposed externally to said frame;

a moveable color filter mechanism mounted to said frame in the path of said beam for varying the color of said beam;

at least one motor for driving said color filter mechanism; and a thermally isolating motor mount for mounting said motor to said frame;

the method comprising:

reflecting said visible portion off said reflector and transmitting a substantial amount of said infrared portion through said reflector to said heat sink, and dissipating heat generated in said reflector by an absorbed portion of said infrared portion to atmosphere with said heat sink.

9. The method according to claim 8, further comprising substantially thermally isolating said motor from said frame.

10. The method according to claim 8, further comprising disposing a heat shield between said motor and said frame.

11. The method according to claim 8, further comprising dissipating heat generated by said motor with a finned heat sink, said finned heat sink having a fin providing a surface suitable for convective heat transfer of heat generated by said motor to atmosphere.

12. The method according to claim 8, further comprising facilitating air flow through said housing.

13. The method according to claim 12, wherein said facilitating comprises providing ventilation holes in said housing.

14. The method according to claim 8, further comprising facilitating ventilation through said frame.

15. The method according to claim 14, wherein said facilitating comprises providing ventilation holes in said frame.

16. The method according to claim 8, further comprising mounting said motor externally of said frame.

17. The method according to claim 8, wherein said lighting instrument further includes a yoke attached to said housing, said yoke having motors for panning and tilting said housing, said method further comprising:

thermally shielding said yoke from said housing.

18. The method according to claim 8, further comprising isolating the air flow environment surrounding said motor from the air flow environment surrounding said color filter mechanism.

19. The method according to claim 8, wherein said method is conducted without the use of a fan.

20. The method according to claim 8, further comprising disposing a non-metallic heat shield between said motor and said frame.

21. A method for managing thermal characteristics in a lighting instrument having variable parameters, said lighting instrument including, a light source for producing radiant energy having a visible portion and an infrared portion;

a housing having a frame and first and second ends for enclosing said light source near said first end, said housing and said frame having ventilation holes for enhancing air flow through said frame and said housing;

a reflector disposed proximally to said light source for reflecting a portion of said energy and forming a light beam projected toward said second end, said reflector including a cold mirror film capable of reflecting said visible portion and transmitting said infrared portion of said energy;

a heat sink disposed proximally to said reflector for dissipating heat from said infrared portion which is transmitted to said reflector, said heat sink having heat conductive fins disposed externally to said frame;

a moveable color filter mechanism mounted to said frame in the path of said beam for varying the color of said beam;

at least one motor for driving said color filter mechanism;

a thermally isolating motor mount for mounting said motor to said frame; and a yoke attached to said housing, said yoke including motors for panning and tilting said housing;

the method comprising:

passively thermally isolating said yoke from said housing.

22. A motorized lighting instrument comprising:

a housing having first and second ends, said housing including a frame and at least one serviceable cover, said frame and said cover having ventilation holes formed therein;

a primary ventilated air chamber formed between said frame and said cover, said primary air chamber extending between said first and second ends of said housing;

a light source enclosed by said housing near said first end, said light source producing radiant energy having a visible portion and an infrared portion;

a reflector disposed proximally to said light source, said reflector including a cold mirror film capable of reflecting said visible portion and transmitting said infrared portion of said energy, and of forming said visible portion into a light beam projected along a path toward said second end of said housing;

a yoke supporting said housing for adjustment about an axis of rotation which is transverse to said path of said light beam;

a primary heat sink disposed proximally to said reflector, said primary heat sink having fins for dissipating heat from said infrared portion of energy transmitted through said reflector, said fins positioned in planes which are parallel to said path of said light beam and transverse to said axis of rotation;

a color filter mechanism supported by said frame in the path of said light beam, said mechanism having moveable color filter elements and at least one color filter motor coupled to a plurality of said filter elements, said color filter motor fixedly attached to a mounting system comprising a heat shielded plate suspended from said frame, a thermally isolating motor mount supported on said heat shield plate, and a finned heat sink thermally coupled to said color filter motor;

a plurality of secondary heat sinks mounted to said frame, said secondary heat sinks having fins extending into said primary ventilated air chamber; and a secondary ventilated air chamber disposed such that the air flow environment of said secondary air chamber is substantially separate from the air flow environment of said primary air chamber, said secondary chamber enclosing said color filter motor and said mounting system, said secondary air chamber being formed between said heat shield plate and said cover, said cover having ventilation holes in a portion thereof which overlays said secondary air chamber.

23. The motorized lighting instrument of claim 22 wherein said color filter elements are supported by filter carrier elements which are journaled for rotation within bearings supported by said frame, said secondary heat sinks being thermally coupled to said bearings.

24. The motorized lighting instrument of claim 22, further comprising:

a motorized mechanism operable to rotate said housing about said axis of rotation;

thermally isolating axle members rotatably coupling said housing to said motorized yoke; and heat shield plates disposed between said yoke and said housing.

25. A method of dissipating heat generated in a lighting instrument having variable parameters without reliance on forced fluid cooling techniques; said lighting instrument comprising, a high intensity light source capable of producing radiant energy having a visible portion and an infrared portion, a reflector having a cold mirror film and a thermally conductive body, said reflector disposed proximally to said light source and capable of forming a light beam from said visible portion, at least one color changing motor coupled to a color filter mechanism mounted in said beam, and a ventilated housing supporting and enclosing said light source and said reflector in a first free air flow environment, and supporting and enclosing said motor in a second free air flow environment;

the method comprising:

reflecting said visible portion from said reflector to form a light beam, transmitting substantially all of said infrared portion through said cold mirror film to said reflector body;

conducting heat produced in said reflector body to a first heat sink having fins disposed externally of said housing;

dissipating said heat produced in said reflector body to atmosphere with said heat sink without relying on forced fluid cooling techniques;

conducting heat produced in said motor to a second heat sink disposed within said housing;

dissipating said heat produced in said motor to said second free air flow environment; and dissipating said heat produced in said motor from said second free air flow environment to atmosphere without relying on forced fluid cooling techniques, whereby said second free air flow environment is maintained substantially unaffected by heat produced in said first free air flow environment and in said reflector body.

* * * * *